United States Patent [19]

Klis et al.

[11] 4,246,803

[45] Jan. 27, 1981

[54] TRACTION CONTROL MECHANISM FOR HYDROSTATIC TRANSMISSION

[76] Inventors: David S. Klis, 3341 Xenia Ave. North, Minneapolis, Minn. 55422; Walter J. Petersen, 8034 Eden Rd., Eden Prairie, Minn. 55343

[21] Appl. No.: 820,115

[22] Filed: Jul. 29, 1977

[51] Int. Cl.[3] ..... G05G 1/14

[52] U.S. Cl. ..... 74/513

[58] Field of Search ..... 74/512, 513

[56] References Cited

U.S. PATENT DOCUMENTS

| | | | |
|---|---|---|---|
| 1,343,378 | 6/1920 | Smith | 74/513 |
| 1,700,643 | 1/1929 | Nordell | 74/513 |
| 1,826,968 | 10/1931 | Townsend et al. | 74/513 |
| 2,003,751 | 6/1935 | Kramer | 74/513 |
| 2,483,224 | 9/1949 | Narcovich | 74/513 |
| 3,023,633 | 3/1962 | Tudos, Jr. | 74/513 |

*Primary Examiner*—Samuel Scott
*Assistant Examiner*—Wesley S. Ratliff, Jr.
*Attorney, Agent, or Firm*—Merchant, Gould, Smith, Edell, Welter & Schmidt

[57] ABSTRACT

A foot pedal is mounted on a control lever operatively connected to a hydrostatic transmission mechanism for a vehicle, for controlling forward and rearward movement of the vehicle. A damping member, operatively associated with the control lever, frictionally engages the pedal to restrain movement of the pedal and control lever, which movement may be caused by heavy vibration of the vehicle during travel over uneven terrain.

5 Claims, 5 Drawing Figures

TRACTION CONTROL MECHANISM FOR HYDROSTATIC TRANSMISSION

BACKGROUND OF THE INVENTION

This invention relates generally to the control of direction and speed of movement of motor driven vehicles, particularly those using hydrostatic transmission mechanisms having a control member operative to place the transmission mechanism selectively in a neutral condition and forward and reverse drive conditions. Such transmission mechanisms are used in lawn and garden tractors, these often traversing uneven ground surfaces. Many such tractors are not generally spring mounted, and possess rather rough riding qualities, only the operator's seat being spring mounted or otherwise cushioned. In such vehicles, a foot pedal or other manually operated devices, such as levers, are used to operate the transmission control member to provide forward and rearward movement and to control the speed of the vehicle during such movements. When the vehicle runs over rough ground, the operator's foot, in the case of a pedal control, is often jarred or jostled to the point of causing the speed of the vehicle to be altered, the jarring movement being difficult to control once it is initiated. Under such conditions, the operator of the vehicle is placed under considerable strain in endeavoring to maintain the vehicle at a constant operating speed, resulting in early and undue fatigue to the operator. The mechanism of this invention effectively prevents involuntary movement to be imparted to the transmission control member, except when the operator's foot is removed from the pedal or, as the case may be, the hand from a control lever; and enables the vehicle to be driven at a substantially constant speed over rough and uneven ground. The transmission mechanism, having means biasing the same toward its neutral condition, assumes this condition when the operator's foot is removed from the pedal or the hand from the control lever, as the case may be.

SUMMARY OF THE INVENTION

The traction control mechanism of this invention involves a mounting shaft, means for supporting the mounting shaft on a vehicle, lever means pivotally mounted at a first portion thereof on said mounting shaft, a control element having inner and outer surfaces, pivot means mounting said control element on said lever means for limited pivotal movement relative to said lever means on an axis in spaced parallel relation to the axis of said mounting shaft, and a fixed motion damping member. A second portion of said lever means, spaced from said first portion thereof, has means for pivotal connection to a transmission control member to impart transmission controlling movements to said control member responsive to pivotal movements of said lever means. The damping member has a surface curving generally in the direction of pivotal movement of the control element, and is disposed to be tangentially engaged by said inner surface of said control element to limit movement of said control element in one direction relative to said lever means. The motion damping member is responsive to pressure applied against said control element and lever means, when said lever means is moved to impart vehicle movement to the transmission, to restrain movement of the control element in either direction of said pivotal movement thereof.

DETAILED DESCRIPTION OF THE PREFERRED EMBODIMENT

Figure 1:
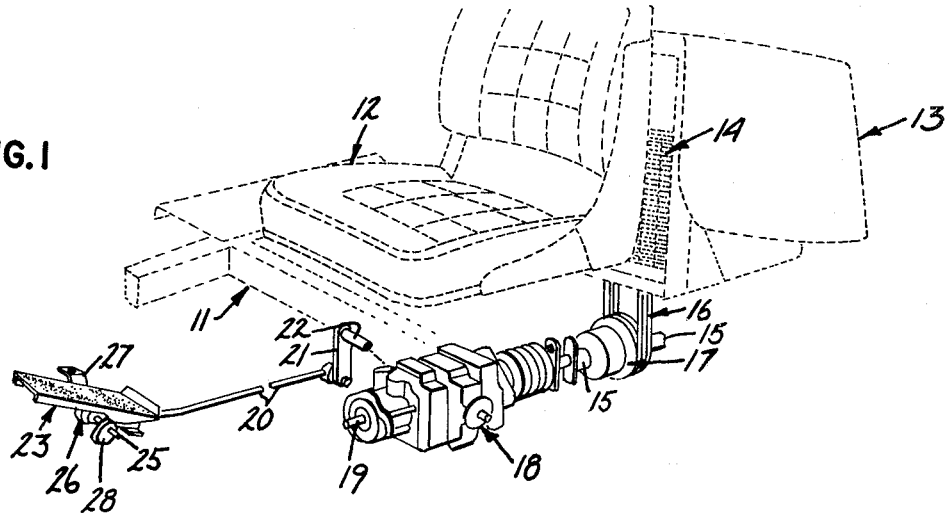
FIG. 1 is a fragmentary view in perspective of a portion of a drive means for a tractor, a portion of the tractor being shown by dotted lines.

In FIG. 1, a portion of a commercially available lawn or garden tractor is shown by dotted lines, a frame being indicated generally at 11 and having an operator's seat 12 mounted thereon. A conventional driving engine is contained beneath a hood 13, and is provided with a conventional cooling system including a radiator 14. A drive shaft 15 may be assumed to be driven by the engine, and drives accessory equipment, not shown, by means of endless belts 16 entrained over a pulley 17, the drive shaft 15 forming the power input to a commercially available hydrostatic transmission mechanism 18. The transmission mechanism 18 terminates in an output shaft 19 that may be assumed to be operatively coupled to the drive wheels of the tractor in the well-known manner. Direction and speed of rotation of the output shaft 19 is controlled by an elongated control rod 20 that is pivotally connected at its rear end to the outer end of a crank arm 21. The inner end of the crank arm 21 is rigidly secured to the outer end of a control shaft 22 that may be assumed to be connected to the pump portion of the hydrostatic transmission mechanism 18 and yieldingly urged toward a neutral position wherein the output shaft 19 is stationary, by well-known and conventional means, not shown.

The apparatus above described is well known, and in and of itself does not comprise the present invention. Hence, further detailed showing and description thereof is omitted, in the interest of brevity. It should suffice to state that heretofore, the front end of the control rod 20 has been connected to a foot pedal or other lever which, when properly manipulated, causes the vehicle to partake of forward or rearward motion, when desired, from a neutral position. The problem with the former arrangement was that, when the tractor was driven over rough ground, the vehicle would partake of jerky up and down movement, causing the operator's foot to inadvertently move the control pedal, thereby affecting the speed of the tractor. The operator would then move the pedal to compensate for the involuntary foot movement just at the time when the vehicle would partake of a second jerky movement, and the problem of compensating would be aggravated. In many instances, the combined jerky movement of the vehicle and attempts by the operator to compensate for involuntary foot movement on the pedal would result in an oscillatory movement being set up in the foot pedal, uneven traction speed, and physical strain on the operator.

Figure 3:
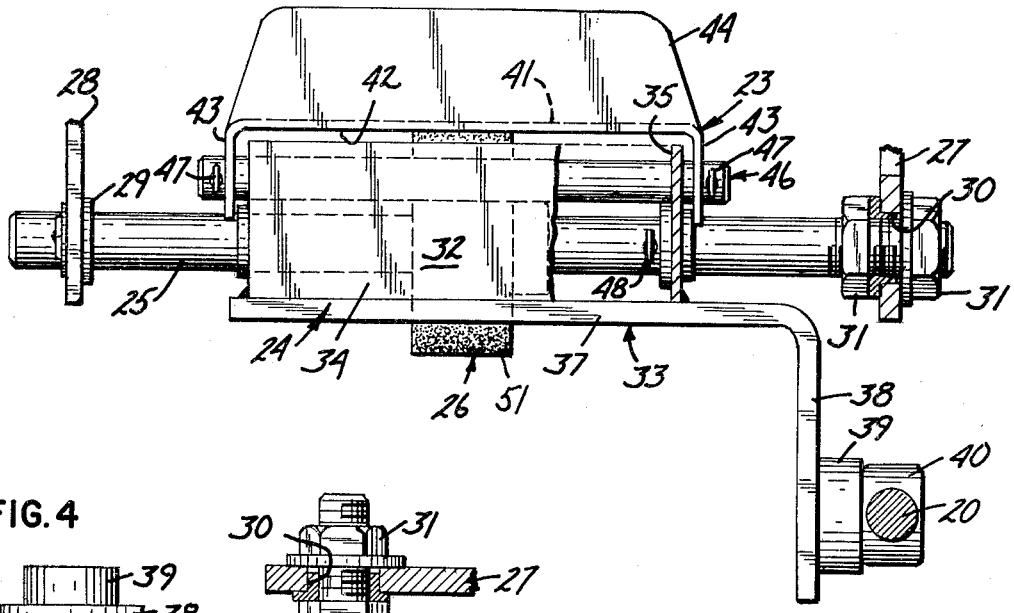
FIG. 3 is a view in rear elevation, as seen from the right to the left with respect to FIG. 2, some parts being removed, some parts being broken away, and some parts being shown in section.
Figure 4:
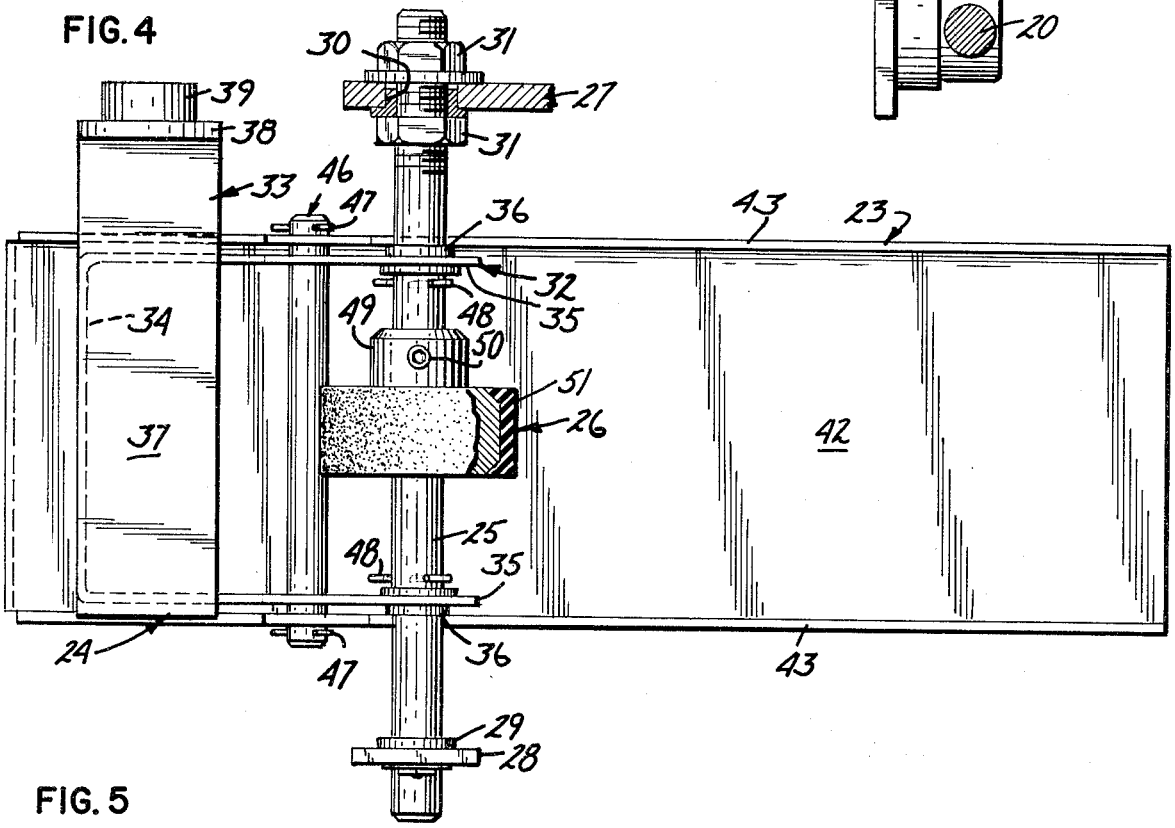
FIG. 4 is a view in bottom plan of the control mechanism, some parts being broken away and some parts being shown in section.
Figure 5:
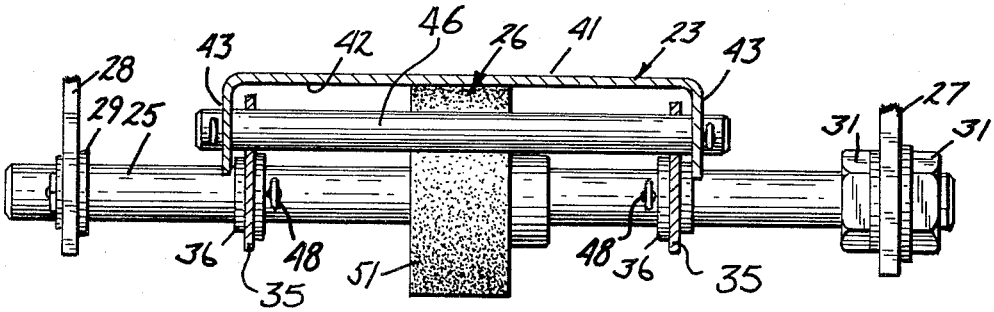
FIG. 5 is a fragmentary section taken generally on the line 5—5 of FIG. 2.

The traction control mechanism of this invention involves a control element which, for the purpose of the present example, is shown as being in the nature of a pedal 23, lever means 24, a mounting shaft 25 for the lever means 24 and a damping member 26. The mounting shaft 25 is supported at its opposite end portions on a generally horizontal axis extending transversely of the direction of movement of the vehicle, by a pair of supporting brackets 27 and 28 that may be assumed to be rigidly mounted on the frame 11 or other portions of the vehicle. As shown in FIGS. 3–5, one end portion of the shaft 25 is mounted in a bearing 29 in the supporting bracket 28, the other end portion of the mounting shaft 25 being screw threaded and received in an opening 30 in the supporting bracket 27. A pair of washer equipped clamping nuts 31 are screw threaded on the shaft 25 at opposite sides of the supporting bracket 27, and are tightened against the bracket 27 to releasably lock the mounting shaft 25 against rotation.

The lever means 24 comprises a generally U-shaped lever portion 32 and an L-shaped lever portion 33. The U-shaped lever portion 32 includes a base portion 34 and a pair of spaced parallel legs 35 the free end portions of which are provided with aligned bearings 36 which journal the lever means 24 at one end on the mounting shaft 25. The L-shaped portion 33 of the lever means 24 includes a generally horizontal leg 37 that is welded or otherwise rigidly secured to the lever portion 32 adjacent the base 34 thereof, and a depending leg 38 which, at its lower end portion, is provided with a boss 39 for pivotal connection to a coupling head 40 at the front end of the control rod 20.

Figure 2:
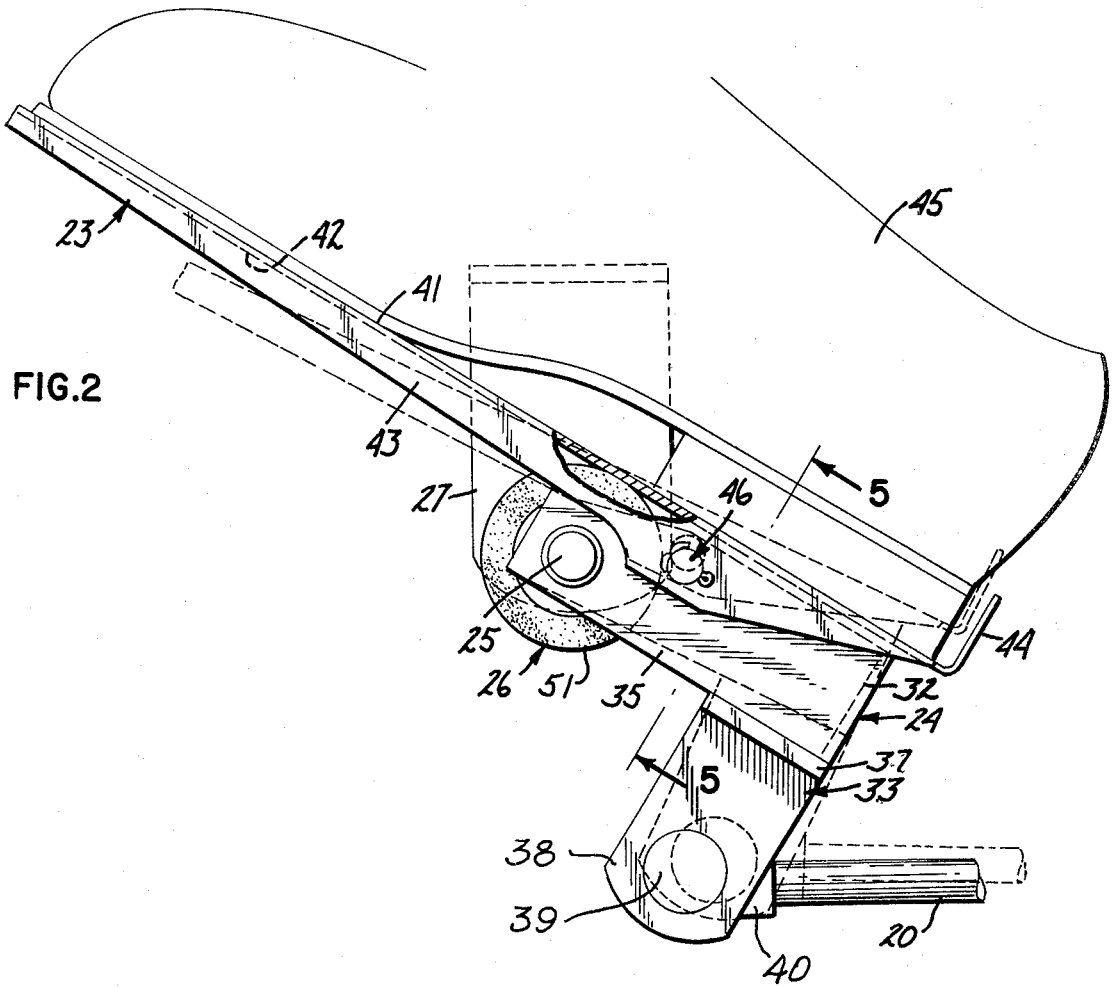
FIG. 2 is an enlarged fragmentary view in side elevation, some parts being broken away and some parts being shown in section.

The foot pedal 23 has an outer or top surface 41 for engagement by the operator's foot or shoe, and an inner or bottom surface 42, the pedal 23 being formed to provide a pair of longitudinally extending depending flanges 43 at its opposite sides, and an upwardly projecting heel rest flange 44 at its rear end. In FIG. 2, an operator's shoe is shown more or less diagrammatically, and indicated at 45.

The legs 35 of the lever means 24, generally rearwardly of the mounting shaft 25, and the depending side flanges 43 toward the rear end of the pedal 23, are provided with aligned openings for reception of pivot means in the nature of a pivot shaft 46 which disposes the bottom surface 42 of the pedal 23 in upwardly spaced relation to the lever means 24, as shown in FIGS. 2, 3 and 5. As shown, the pivot shaft 46 is provided with cotter pins 47 adjacent its opposite ends to limit axial movement of the shaft 46 relative to the pedal 23 and lever legs 35, the mounting shaft 25 being provided with similar cotter pins 48 to limit lateral movements of the lever means 24 and pedal 23.

The fixed motion damping member of this invention comprises a hub portion 49 that is rigidly mounted on the mounting shaft 25 and secured thereon by a pin or set screw 50, and a rim portion 51 having a cylindrical outer surface that can tangentially engage the inner or bottom surface 42 of the pedal 23. The rim portion 51 is preferably made from elastic material, such as rubber, having a hardness of between 75 and 85 durometer measurement and a tensile strength of at least 1,000 psi.

The lever means 24 and pedal 23 are so situated relative to the transmission 18 that, when the transmission is in a neutral state, and the operator's foot or shoe 45 is removed from the pedal 23, the pedal 23 rests lightly on the damping member 26 and the bottom surface 42 at the rear end portion of the pedal 23 is upwardly spaced from the underlying lever means 24. When the operator decides to move the vehicle in a rearward direction, foot pressure is applied against the rear end portion of the pedal 23, causing the same to move pivotally on the axis of the shaft 46, causing the pedal 23 to be disengaged from the damping member 26 and the rear end portion of the pedal 23 to engage the base portion 34 of the lever portion 32. Further downward movement of the rear end portion of the pedal 23 will cause the lever means 24 to pivot about the axis of the mounting shaft 25 to impart forward movement to the transmission control rod 20, this causing the output shaft 19 to be rotated in a direction to drive the vehicle in a rearward direction. Conversely, when it is desired to drive the vehicle in a forward direction, the operator exerts downward foot pressure on the front end portion of the pedal 23, causing the bottom surface 42 to frictionally engage the rim portion 51 of the damping member 26, the shaft 46 imparting pivotal movement to the lever means 24, as shown by dotted lines in FIG. 2, to cause forward movement to be imparted to the vehicle. As forward and downward movement is imparted to the front end portion of the pedal 23, friction between the damping member 26 and bottom pedal surface 42 is sufficient to place a drag on the pedal 23 against such movement but not sufficient to prevent the forward and downward movement of the pedal 23. However, during forward movement of the vehicle at a constant speed, the amount of friction between the rim portion 51 of the damping element 26 and the bottom surface 42 of the pedal 23 is sufficient to prevent involuntary movement of the pedal 23 and lever means 24 when the weight of the operator's foot is disposed on the pedal 23. Thus, when the vehicle moves over rough and uneven ground, control of the speed of the vehicle is unaffected by jerking or jogging movements of the vehicle, caused by unevenness of the ground surface, and no oscillation of the pedal 23 or lever means 24 occurs.

Should the pedal engaging portion of the cylindrical surface of the damping member 26 become worn after extended use, it is only necessary to loosen one of the clamping screws 31 and rotate the mounting shaft 25 sufficiently to bring a different cylindrical surface portion of the damping member 26 into position to be engaged by the bottom surface 42 of the pedal 23, and thereafter retighten the loosened clamping nut 31.

While we have shown and described a preferred embodiment of traction control mechanism for a hydrostatic transmission, it will be understood that the same is capable of modification, and that modification may be made without departure from the spirit and scope of the invention, as defined in the claims.

What is claimed is:

1. Traction control mechanism for a hydrostatic transmission, said traction control mechanism comprising:

(a) a mounting shaft;

(b) means for supporting the mounting shaft on a vehicle;

(c) lever means having spaced apart first and second lever portions connected together, said first lever portion being pivotally mounted on said mounting shaft;

(d) said second lever portion having means for pivotal connection to a transmission control member to impart transmission controlling movements to said control member responsive to pivotal movements of said lever means;

(e) a control element having inner and outer surfaces;

(f) pivot means mounting said control element to said lever means in overlying relationship thereto and for limited pivotal movement relative to said lever means on an axis in spaced parallel relation to the axis of said mounting shaft;

(g) and a fixed motion damping member having a surface curving generally in the direction of pivotal movement of said control element, said damping member surface being disposed to be tangentially engaged by said inner surface of said control element to impede movement of said control element in one direction relative to said lever means, said motion damping member being responsive to pressure applied against said control element and lever means, when said lever means is moved to impart vehicle movement to the transmission, to restrain movement of the control element in either direction of said pivotal movement thereof;

(h) said control element and lever means being mounted for movements selectively in opposite directions from respective given neutral positions to provide for neutral, forward and reverse directional operation of said transmission.

2. The traction control mechanism defined in claim 1 in which said control element is disposed to frictionally engage said damping member during forward vehicle movement control positions of said transmission control member, and to be disengaged from said damping member during reverse vehicle movement control positions of said transmission control member.

3. Traction control mechanism for a hydrostatic transmission, said traction control mechanism comprising:

(a) a mounting shaft;

(b) means for supporting the mounting shaft on a vehicle;

(c) lever means having spaced apart first and second lever portions connected together, said first lever portion being pivotally mounted on said mounting shaft;

(d) said second lever portion having means for pivotal connection to a transmission control member to impart transmission controlling movements to said control member responsive to pivotal movements of said lever means;

(e) a control element having inner and outer surfaces;

(f) pivot means mounting said control element to said lever means in overlying relationship thereto and for limited pivotal movement relative to said lever means on an axis in spaced parallel relation to the axis of said mounting shaft;

(g) and a fixed motion damping member having a surface curving generally in the direction of pivotal movement of said control element, said damping member surface being disposed to be tangentially engaged by said inner surface of said control element to impede movement of said control element in one direction relative to said lever means, said motion damping member being responsive to pressure applied against said control element and lever means, when said lever means is moved to impart vehicle movement to the transmission, to restrain movement of the control element in either direction of said pivotal movement thereof; said motion damping member comprising a generally cylindrical drum mounted on said mounting shaft coaxial therewith including a hub portion and a cylindrical rim of elastic material fixed on said drum and disposed for tangential frictional engagement with said inner surface of the control element.

4. Traction control mechanism for a hydrostatic transmission comprising:

(a) a mounting shaft;

(b) means for supporting the mounting shaft on a vehicle on a first generally horizontal axis;

(c) lever means pivotally mounted on said mounting shaft; and having means for connection to a transmission control member to impart transmission controlling movements to said control member responsive to pivotal movements of said lever means;

(d) a control pedal having top and bottom surfaces;

(e) pivot means mounting said pedal to said lever means in overlying relationship thereto for limited pivotal movement relative to said lever means on a second axis in spaced parallel relation to the axis of said mounting shaft; and (f) a fixed motion damping member having a surface curving generally in the direction of pivotal movement of said pedal and disposed in underlying tangential engagement with the bottom surface of said pedal and in the path of pivotal movement of said pedal about said second axis to limit pivotal movement of said pedal in one direction relative to said lever means while providing a bearing surface to permit said pedal to pivot said lever means, said damping member being responsive to foot pressure applied against said pedal and lever means, when said lever means is moved to impart vehicle movement to the transmission, to impede movement of the pedal in either direction of said pivotal movement thereof.

5. Traction control mechanism for a hydrostatic transmission comprising:

(a) a mounting shaft;

(b) means for supporting the mounting shaft on a vehicle on a first generally horizontal axis;

(c) lever means pivotally mounted on said mounting shaft; and having means for connection to a transmission control member to impart transmission controlling movements to said control member responsive to pivotal movements of said lever means;

(d) a control pedal having top and bottom surfaces;

(e) pivot means mounting said pedal to said lever means in overlying relationship thereto for limited pivotal movement relative to said lever means on an axis in spaced parallel relation to the axis of said mounting shaft;

(f) a fixed motion damping member having a surface curving generally in the direction of pivotal movement of said pedal and disposed in underlying tangential engagement with the bottom surface of said pedal to limit pivotal movement of said pedal in one direction relative to said lever means, said damping member being responsive to foot pressure applied against said pedal and lever means, when said lever means is moved to impart vehicle movement to the transmission, to impede movement of the pedal in either direction of said pivotal movement thereof;

(g) said lever means having one end portion pivotally connected to said mounting shaft and an opposite end portion pivotally secured to said transmission control member, said pedal having front and rear ends and being pivotally secured intermediate its ends to said lever means intermediate said end portions of the lever means, with the pivotal connection between said pedal and said lever means disposed rearwardly of the pivotal connection of said lever means to said mounting shaft, said damping member being mounted on said mounting shaft so as to engage said pedal when the front end of the pedal is moved generally downwardly; and (h) said damping member comprises a hub portion fixed on said mounting shaft and a cylindrical rim portion of elastic material fixed on said hub portion, said means for supporting the mounting shaft including a supporting bracket, characterized by anchoring means on said shaft and operatively engaging said supporting bracket to releasably lock said mounting shaft against rotation relative to said bracket.

* * * * *